US009525208B2

(12) United States Patent
Chen et al.

(10) Patent No.: US 9,525,208 B2
(45) Date of Patent: Dec. 20, 2016

(54) MULTIBAND ANTENNA

(71) Applicant: Wistron NeWeb Corporation, Hsinchu (TW)

(72) Inventors: I-Shan Chen, Hsinchu (TW); Chia-Hong Lin, Hsinchu (TW); Yu-Chun Huang, Hsinchu (TW); Hsin-Lung Hsiao, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 115 days.

(21) Appl. No.: 14/155,383

(22) Filed: Jan. 15, 2014

(65) Prior Publication Data

US 2015/0048989 A1 Feb. 19, 2015

(30) Foreign Application Priority Data

Aug. 19, 2013 (TW) ..... 102129691 A

(51) Int. Cl.
*H01Q 5/00* (2015.01)
*H01Q 9/42* (2006.01)
(Continued)

(52) U.S. Cl.
CPC ..... *H01Q 5/321* (2015.01); *H01Q 5/378* (2015.01); *H01Q 9/42* (2013.01)

(58) Field of Classification Search
CPC ..... H01Q 5/30; H01Q 5/307; H01Q 5/342; H01Q 5/378; H01Q 5/385; H01Q 5/40; H01Q 5/50; H01Q 19/005; H01Q 19/22; H01Q 19/26; H01Q 19/28; H01Q 19/32; H01Q 5/357; H01Q 5/392; H01Q 9/04; H01Q 9/0407; H01Q 9/0421; H01Q 9/045; H01Q 9/0457; H01Q 9/30
(Continued)

(56) References Cited

U.S. PATENT DOCUMENTS 6,285,325 B1 9/2001 Nalbandian
6,614,401 B2 * 9/2003 Onaka ..... H01Q 1/243 343/702
(Continued)

FOREIGN PATENT DOCUMENTS

CN 1742406 A 3/2006

OTHER PUBLICATIONS

S.C. Chen and K.L. Wong, "Bandwidth enhancement of coupled-fed on-board printed PIFA using bypass radiating strip for eight-band LTE/WWAN slim mobile phone, " Microwave and Optical Technology Letters, vol. 52, No. 9, pp. 2059-2065, Sep. 2010.
(Continued)

*Primary Examiner* — Sue A Purvis
*Assistant Examiner* — Patrick Holecek
(74) *Attorney, Agent, or Firm* — Winston Hsu; Scott Margo

(57) ABSTRACT

A multiband antenna for receiving or transmitting wireless signals of a plurality of frequency bands includes a grounding sheet, formed with a hole at a first side, for providing grounding, a first micro-strip line, substantially parallel to the first side of the grounding sheet, a connecting unit, connecting to the first side of the grounding sheet and the first micro-strip line, for forming a resonant cavity with the first side of the grounding sheet and the first micro-strip line, a second micro-strip line, formed in the resonant cavity and substantially parallel to the first micro-strip line, a third micro-strip line, extending from the hole of the grounding sheet to the second micro-strip line, and a feed-in terminal, formed on the third micro-strip line within the hole, for transmitting the wireless signals.

9 Claims, 9 Drawing Sheets

(51) Int. Cl.
*H01Q 5/321* (2015.01)
*H01Q 5/378* (2015.01)

(58) Field of Classification Search
USPC ..... 343/700 MS, 702
See application file for complete search history.

(56) References Cited

U.S. PATENT DOCUMENTS

| | | | | |
|---|---|---|---|---|
| 6,714,162 | B1 * | 3/2004 | Kadambi | H01Q 1/243 343/700 MS |
| 2013/0300626 | A1 * | 11/2013 | Lee | H01Q 1/50 343/850 |
| 2015/0022422 | A1 * | 1/2015 | Chang | H01Q 1/243 343/861 |

OTHER PUBLICATIONS

K.L. Wong, W.Y. Chen and T.W.Kang, "On-board printed coupled-fed loop antenna in close proximity to the surrounding ground plane for penta-band WWAN mobile phone," IEEE Transactions on Antennas and Propagation., vol. 59, No. 3, pp. 751-757, Mar. 2011.

* cited by examiner

MULTIBAND ANTENNA

BACKGROUND OF THE INVENTION

1. Field of the Invention

The present disclosure relates to a multiband antenna, and more particularly, to a multiband antenna for multiband operation and with a plurality of adjustable factors.

2. Description of the Prior Art

An antenna is utilized for transmitting or receiving radio frequency waves so as to communicate or exchange wireless signals. An electronic product with wireless communication functionality, such as a laptop and a personal digital assistant (PDA), usually accesses a wireless network through a built-in antenna. Therefore, to facilitate access to the wireless communication network, an ideal antenna should have a wide bandwidth and a small size to meet the trends of compact electronic products within a permissible range, so as to integrate the antenna into a portable wireless communication equipment. However, with advances in wireless communication technology, operating frequencies of different wireless communication systems may vary, and thereby, an ideal antenna should cover bandwidths required for different wireless communication networks with a single antenna.

For multiband applications in the prior art, a plurality of antennas or a plurality of radiation entities (e.g., slots in a slot antenna and branches in a dipole antenna) are commonly employed to respectively transmit and receive wireless signals of different frequency bands. Nevertheless, apart from complicating design further, the entire area of an antenna becomes larger as the required frequency bands increases. If the available space for the antennas is limited, interference may occur among the antennas, which significantly affects performance of the antennas. Therefore, providing an antenna of small size that allows multiband operation is a significant objective in the field.

SUMMARY OF THE INVENTION

It is therefore a primary objective of the present invention is to provide a multiband antenna so as to achieve multiband operation in a limited area.

An embodiment of the invention provides a multiband antenna for receiving or transmitting wireless signals of a plurality of frequency bands. The multiband antenna comprises a grounding sheet, formed with a hole at a first side, for providing grounding; a first micro-strip line, substantially parallel to the first side of the grounding sheet, having a length substantially equal to half of a wavelength of a wireless signal corresponding to a lowest frequency band of the plurality of frequency bands; a connecting unit, connecting a terminal of the first side of the grounding sheet and a terminal of the first micro-strip line, for forming a resonant cavity with the first side of the grounding sheet and the first micro-strip line; a second micro-strip line, disposed in the resonant cavity, substantially parallel to the first micro-strip line, and substantially separated from the first micro-strip line by a first gap; a third micro-strip line, extending from the hole of the grounding sheet to a terminal of the second micro-strip line, and substantially separated from the grounding sheet by a second gap around the hole; and a feed-in terminal, formed on the third micro-strip line within the hole, for transmitting the wireless signals of the plurality of frequency bands.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
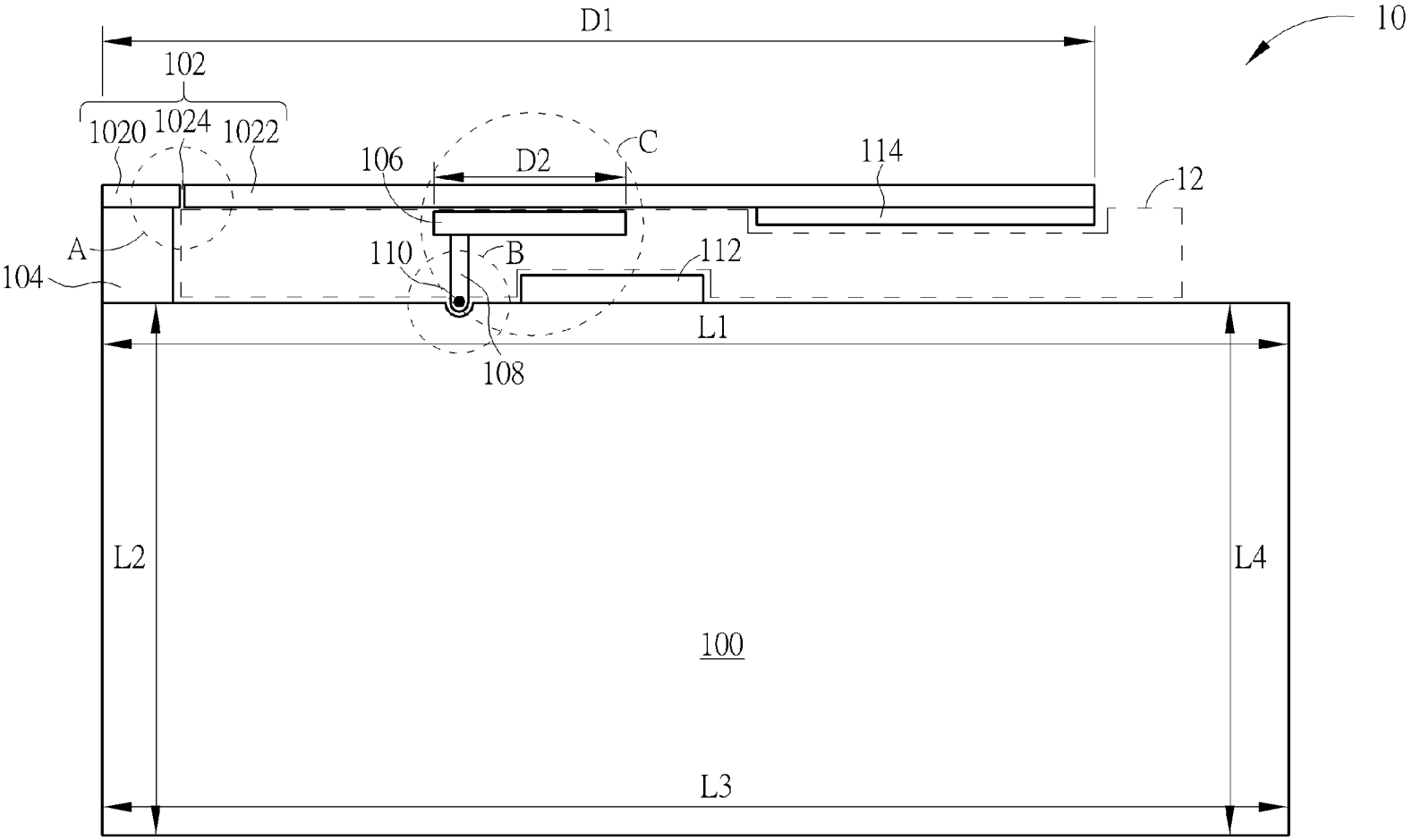
FIG. 1A is a schematic diagram illustrating a multiband antenna according to an embodiment of the present invention.
Figure 1B:
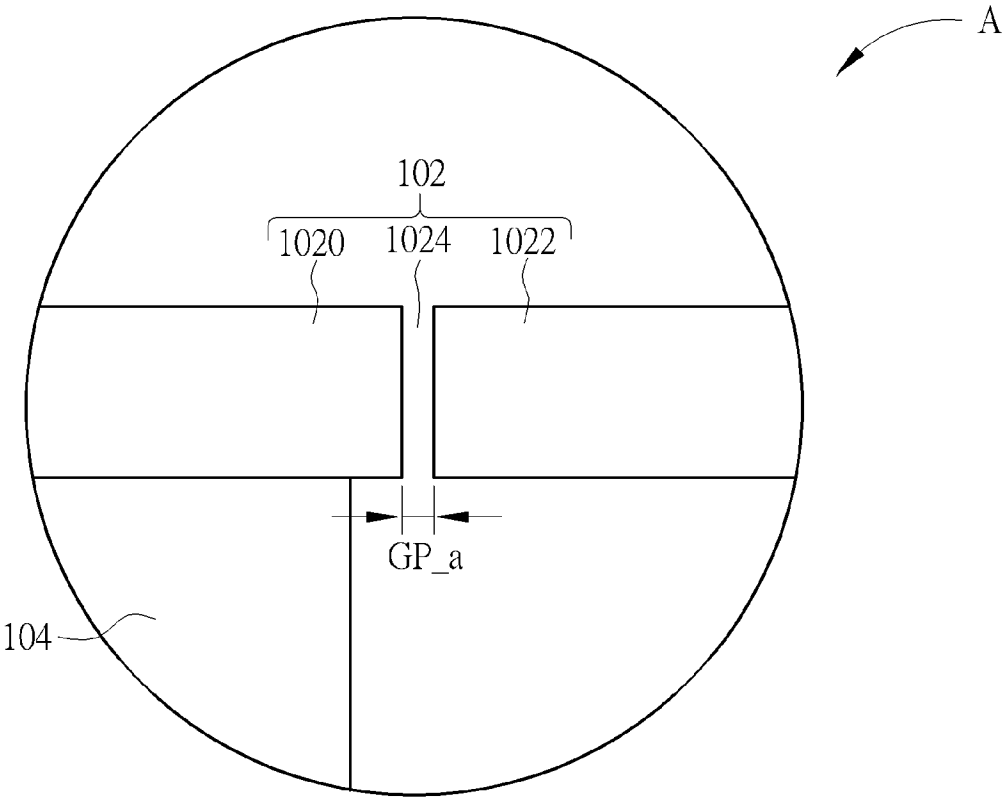
FIGS. 1B to 1D are schematic diagrams respectively illustrating different enlarged parts shown in FIG. 1A.
Figure 1C:
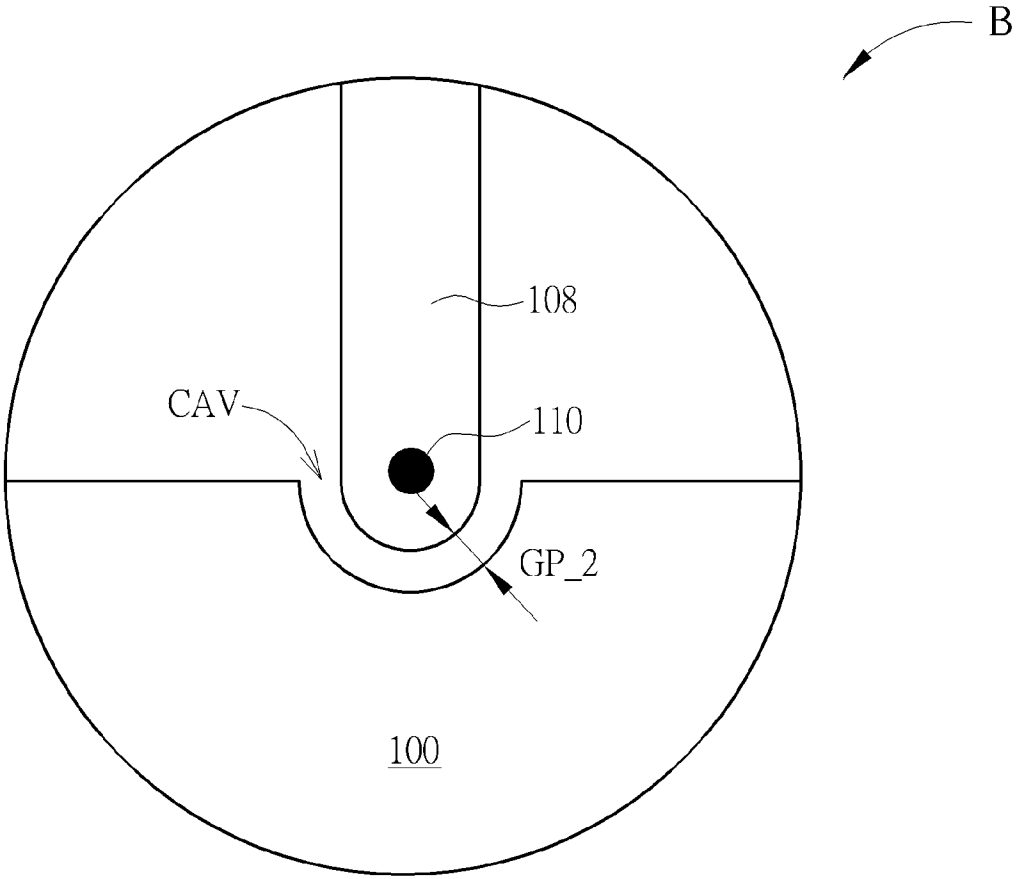
Figure 1D:
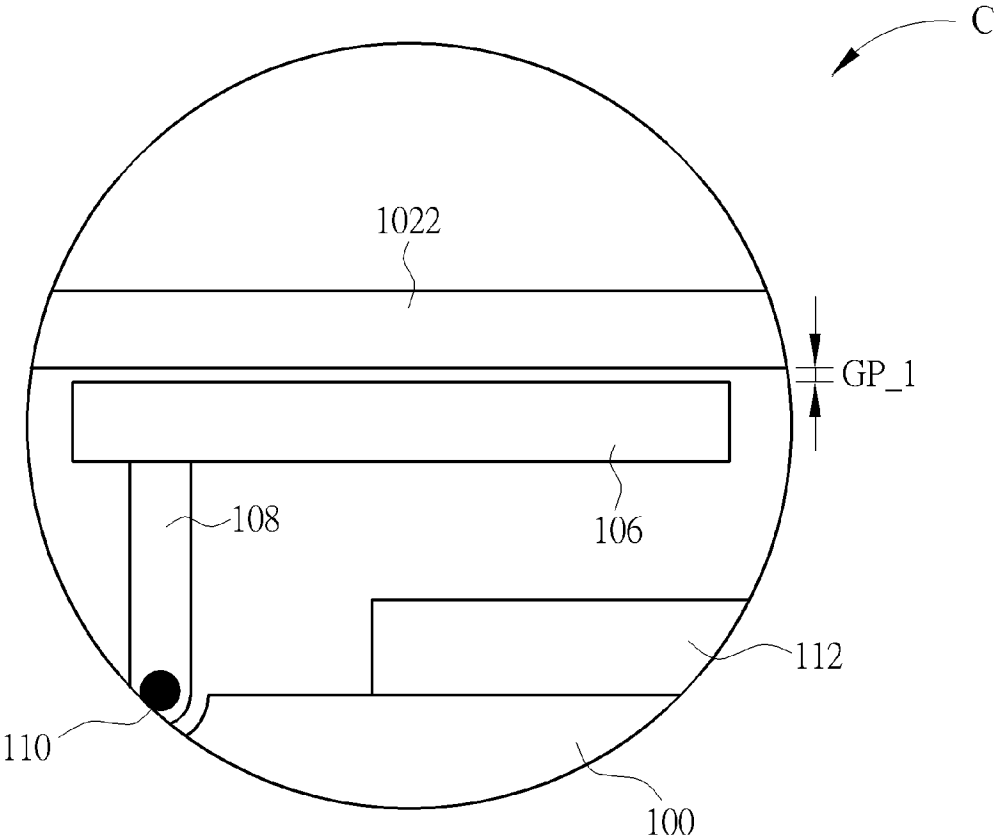

Please refer to FIGS. 1A to 1D. FIG. 1A is a schematic diagram illustrating a multiband antenna 10 according to an embodiment of the present invention. FIGS. 1B to 1D are schematic diagrams respectively illustrating enlarged parts A, B and C shown in FIG. 1A. The multiband antenna 10 is utilized for transmitting or receiving wireless signals of a plurality of frequency bands, and includes a grounding sheet 100, a first micro-strip line 102, a connecting unit 104, a second micro-strip line 106, a third micro-strip line 108, a feed-in terminal 110 and matching blocks 112 and 114. The grounding sheet 100 is utilized for providing grounding, and has a shape substantially conforming to a rectangle with four sides L1-L4. The grounding sheet 100 is formed with a hole CAV at the first side L1. The first micro-strip line 102 is substantially parallel to the first side L1 of the grounding sheet 100, and a length D1 of the first micro-strip line 102 is substantially equal to half of a wavelength of a wireless signal in a lowest frequency band of the plurality of frequency bands to be received or transmitted. In this embodiment, the first micro-strip line 102 is composed of sub micro-strip lines 1020 and 1022, which are separated by a distance GP_a; namely, a gap 1024 with a gap distance of GP_a is formed in the first micro-strip line 102 to divide the first micro-strip line 102 into the sub micro-strip lines 1020 and 1022. The connecting unit 104 connects a terminal of the first side L1 of the grounding sheet 100 and a terminal of the first micro-strip line 102 to form a resonant cavity 12 with the first side L1 of the grounding sheet 100 and the first micro-strip line 102. The second micro-strip line 106 is disposed within the resonant cavity 12, substantially parallel to the first micro-strip line 102, and substantially separated from the first micro-strip line 102 by a first gap GP_1. The third micro-strip line 108 extends from the hole CAV of the grounding sheet 100 to a terminal of the second micro-strip line 106 and is substantially separated from the grounding sheet 100 by a second gap GP_2 around the hole CAV. The feed-in terminal 110 is formed on the third micro-strip line 108 within the hole CAV for transmitting the wireless signals. In addition, the matching blocks 112 and 114 respectively extend from the first side L1 of the grounding sheet 100 and the first micro-strip line 102 toward the resonant cavity 12, for adjusting properties (such as impedance matching and angular distribution of antenna radiation pattern) of the multiband antenna 10.

Therefore, the third micro-strip line 108 and the grounding sheet 100 forms a coplanar waveguide (CPW) structure around the hole CAV and directly connects (electrically connects) the second micro-strip line 106. In other words, the third micro-strip line 108 may be regarded as an architecture of which a CPW feed-in structure converts into a micro-stripe structure so as to transmit the feed-in terminal 110 to the second micro-strip line 106. Consequently, a position of the hole CAV at the first side L1, the second gap GP_2 separating the third micro-strip line 108 from the grounding sheet 100 around the hole CAV, and so on relate to properties of the multiband antenna 10, such as operating frequency and radiation efficiency. For example, a size of the second gap GP_2 is inversely proportional to an impedance from the third micro-strip line 108 to the grounding sheet 100; that is, a shorter distance of the second gap GP_2 results in a higher impedance from the third micro-strip line 108 to the grounding sheet 100. In such a situation, the size of the second gap GP_2 can be appropriately designed to have the impedance from the third micro-strip line 108 to the grounding sheet 100 to be between an impedance (e.g. 50Ω) of a transmission line connecting the feed-in terminal 110 and an antenna radiation impedance (e.g. 177Ω) of the second micro-strip line 106, such as 60Ω to 100Ω.

Furthermore, after currents flow to the second micro-strip line 106 via the third micro-strip line 108, the second micro-strip line 106 generates horizontal currents so as to activate a frequency band. Moreover, the second micro-strip line 106 may be coupled to the first micro-strip line 102 so as to generate vertical currents from the second micro-strip line 106 to the first micro-strip line 102, such that coupling effects between the second micro-strip line 106 and the first micro-strip line 102 can activate another frequency band. Namely, a length D2 of the second micro-strip line 106, the first gap GP_1 separating the second micro-strip line 106 from the first micro-strip line 102, a position of the second micro-strip line 106 within the resonant cavity 12 (such as a position opposite to the first micro-strip line 102) and so on relate to properties of the multiband antenna 10 (such as operating frequency and radiation efficiency).

In addition, a current coupled from the second micro-strip line 106 to the first micro-strip line 102 flows into the grounding sheet 100, such that resonance of the resonant cavity 12 occurs to activate another frequency band. As a result, the length D1 of the first micro-strip line 102 affects the properties (such as operating frequency and radiation efficiency) of the multiband antenna 10. Moreover, since the first micro-strip line 102 is divided into the sub micro-strip lines 1020 and 1022 by the gap 1024, and a current is conducted between the sub micro-strip lines 1020 and 1022 via coupling effects, the position or the distance GP_a of the gap 1024 also relates to operating frequency, radiation efficiency, etc. of the multiband antenna 10. Also, the matching blocks 112 and 114 are employed to adjust impedance matching and angular distribution of antenna radiation pattern and so forth, and hence a position, a shape and so forth may be appropriately adjusted so as to meet system requirements.

As can be seen, adjustable factors, such as the length D1 of the first micro-strip line 102, the length D2 of the second micro-strip line 106, the first gap GP_1 separating the first micro-strip line 102 from the second micro-strip line 106, the position of the second micro-strip line 106 within the resonant cavity 12 (such as the position opposite to the first micro-strip line 102), the position of the hole CAV at the first side L1, the second gap GP_2 separating the third micro-strip line 108 from the grounding sheet 100 around the hole CAV, the position or shape of the matching block 112 and 114, etc. all relate to radiation parameters (such as operating frequency and radiation efficiency) of the multiband antenna 10, such that the properties of the multiband antenna 10 maybe appropriately adjusted if necessary. In other words, the multiband antenna 10 meets multiband requirements in one single antenna unity, thereby preventing the need of increasing the entire antenna volume in the prior art.

Figure 2:
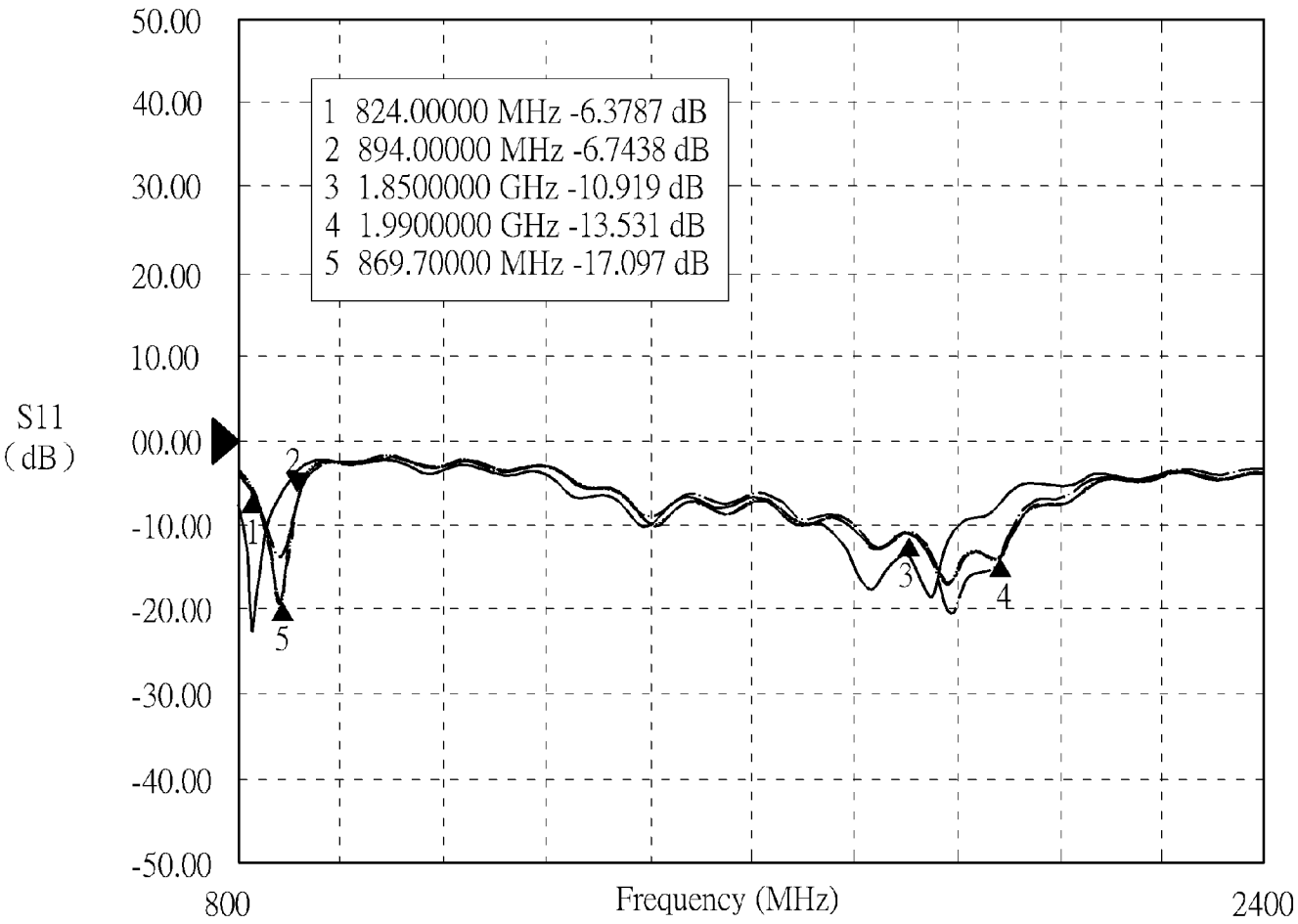
FIG. 2 is a schematic diagram illustrating return loss of the multiband antenna shown in FIG. 1A.
Figure 3:
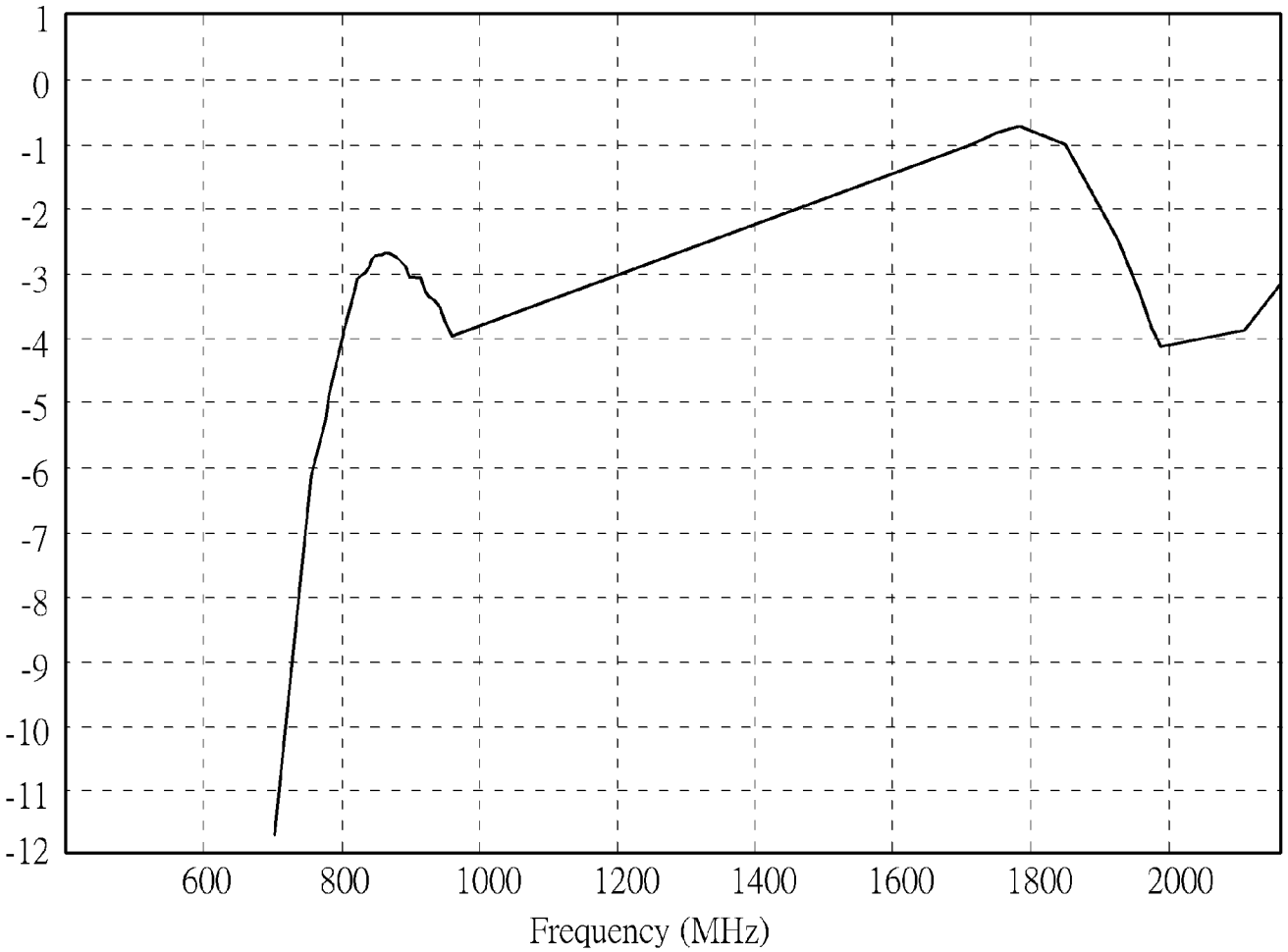
FIG. 3 is a schematic diagram illustrating radiation efficiency of the multiband antenna shown in FIG. 1A.

For example, North American smart meters require to meet the communication standards of CDMA2000, WCDMA and GSM, i.e., at least eight frequency bands must be covered. In the eight frequency bands, low frequency bands are in a range of 824 MHz to 960 MHz and may be classified into CDMA BC0-CELL (824 MHz to 849 MHz for transmitting and 869 MHz to 894 MHz for receiving), WCDMA B5-CELL (824 MHz to 849 MHz for upstream and 869 MHz to 894 MHz for downstream), GSM 850 (824 MHz to 849 MHz for upstream and 869 MHz to 894 MHz for downstream) and GSM 900 (880 MHz to 915 MHz for upstream and 925-960 MHz for downstream) according to communication systems; and high frequency bands are in a range of 1710 MHz to 2170 MHz and cover CDMA BC1-PCS (1850 MHz to 1990 MHz), CDMA BC1-PCS (1850 MHz to 1910 MHz for transmitting and 1930 MHz to 1990 MHz for receiving), WCDMA B1-IMT (1920 MHz to 1980 MHz for upstream and 2110 MHz to 2170 MHz for downstream), WCDMA B2-PCS (1850 MHz to 1910 MHz for upstream and 1930 MHz to 1990 MHz for downstream), GSM DCS (1710 MHz to 1785 MHz for upstream and 1805 MHz to 1875 MHz for downstream) and GSM PCS (1850 MHz to 1910 MHz for upstream and 1930 MHz to 1990 MHz for downstream) according to communication systems. For such a large bandwidth application, a plurality of antennas or a plurality of radiation entities (for example, slots in a slot antenna and branches in a dipole antenna) are required in the prior art, which results in a remarkable increase in the antenna size. In contrast, by adjusting the length D1, the length D2, the first gap GP_1, the position of the second micro-strip line 106 within the resonant cavity 12 (such as the position opposite to the first micro-strip line 102), the position of the hole CAV at the first side L1, the second gap GP_2 and the position or shape of the matching blocks 112 and 114, the present invention can achieve return loss as shown in FIG. 2 and radiation efficiency as shown in FIG. 3. As can be seen from FIGS. 2 and 3, after adjusting the adjustable factors, the multiband antenna 10 meets the requirements of multi-frequency bands and anti-noise, and therefore satisfies the communication requirements of North American smart meters without extra radiation entity to maintain the entire area. Note that, curves presented in FIG. 2 represent return loss that the multiband antenna 10 can achieve by adjusting the adjustable factors, which proves the present invention a more efficient way of bring design flexibility.

Figure 4:
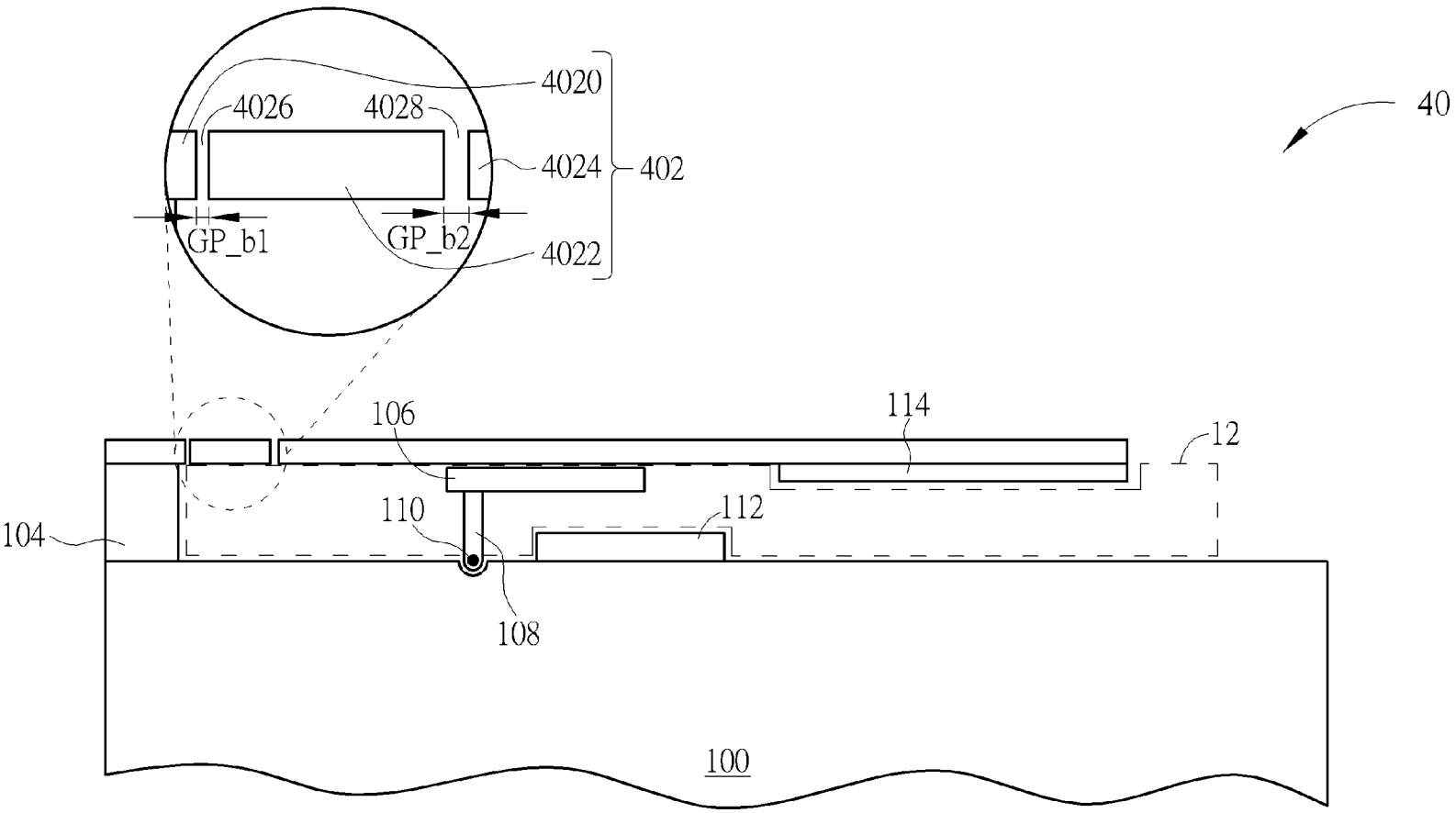
FIG. 4 is a schematic diagram illustrating a multiband antenna according to an embodiment of the present invention.

It is worth noting that the multiband antenna 10 as shown in FIG. 1A is merely an embodiment of the present invention, and those skilled in the art might make modifications or alterations accordingly but not limited thereto. For example, in the multiband antenna 10, the first micro-strip line 102 only comprises one single gap 1024 for controlling the occurrence of transmission zeros; nevertheless, the present invention is not limited to this, and the number of gaps, a position of each gap and a width of each gap formed within the first micro-strip line 102 may be properly modified. For example, FIG. 4 is a schematic diagram illustrating a multiband antenna 40 according to an embodiment of the present invention. Since the structure of the multiband antenna 40 is similar to that of the multiband antenna 10 in FIG. 1A, the same numerals and symbols denote the same components in the following description, and the identical parts are not detailed redundantly. Unlike the multiband antenna 10, a first micro-strip line 402 of the multiband antenna 40 is composed of sub micro-strip lines 4020, 4022 and 4024, which are respectively separated by distances GP_b1 and GP_b2; namely, a gap 4026 with a gap distance of GP_b1 and a gap 4028 with a gap distance of GP_b2 are respectively formed in the first micro-strip line 402 to divide the first micro-strip line 402 into the sub micro-strip lines 4020, 4022 and 4024.

Figure 5:
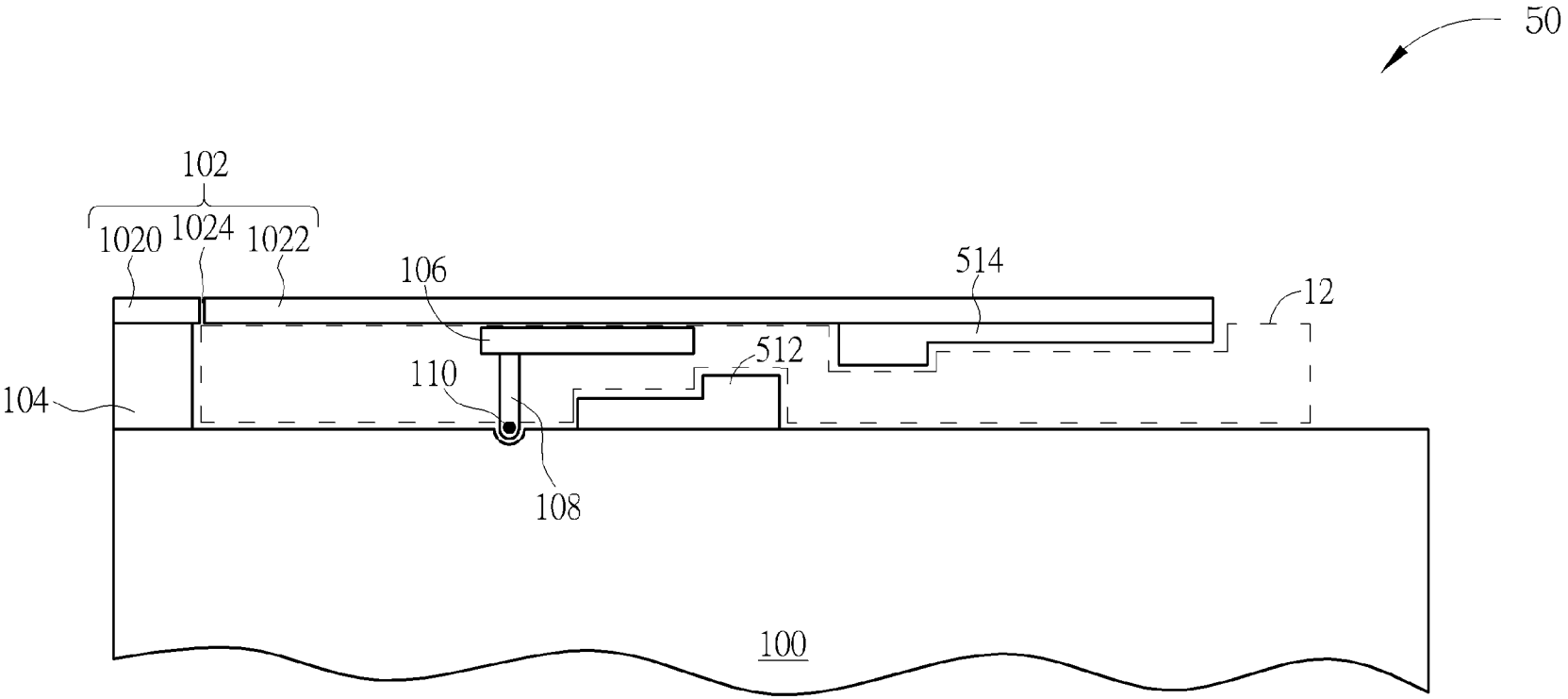
FIG. 5 is a schematic diagram illustrating a multiband antenna according to an embodiment of the present invention.
Figure 6:
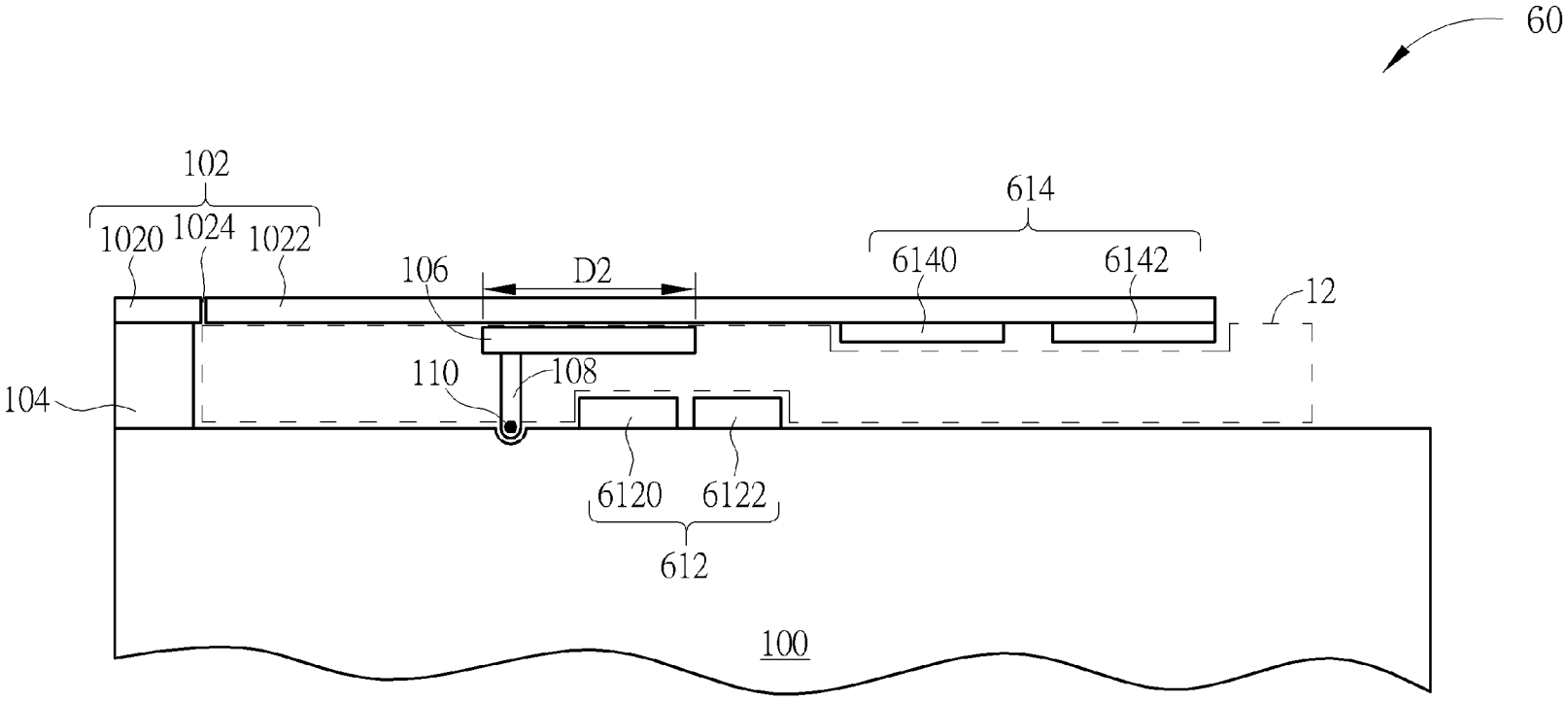
FIG. 6 is a schematic diagram illustrating a multiband antenna according to an embodiment of the present invention.

Besides, the matching blocks 112 and 114 are utilized to achieve impedance matching, and positions, shapes, etc. can be appropriately modified. For example, FIGS. 5 and 6 are schematic diagrams respectively illustrating multiband antennas 50 and 60 according to embodiments of the present invention. The structures of the multiband antennas 50 and 60 are similar to the structure of the multiband antenna 10 in FIG. 1A, and thus the same numerals and symbols denote the same components in the following description. Different from the multiband antenna 10, matching blocks 512 and 514 of the multiband antenna 50 are formed in a stepwise shape, and matching blocks 612 and 614 of the multiband antenna 60 respectively include sub regions 6120, 6122, 6140 and 6142, which are still within the scope of the present invention.

The multiband antennas 40, 50, 60 as shown in FIG. 4 to FIG. 6 are derived from the multiband antenna 10; therefore, the aforementioned adjustable factors such as the lengths D1, D2, the distances GP_1, GP_2, the position of the second micro-strip line 106 within the resonant cavity 12 and the position of the hole CAV at the first side L1 can be utilized to modify the properties of the multiband antenna. Also, there are still other adjustable factors for modifying the properties of the multiband antenna. Besides, other variables such as an area or shape of the grounding sheet 100, a shape, length or width of the connecting unit 104 and so on may be further utilized to modify the properties of the multiband antenna. In addition, in the above-mentioned embodiments, the hole CAV is employed to form a CPW structure. Due to the semicircular shape of the hole CAV, a via hole maybe applied, such that the third micro-strip line 108 and the grounding sheet 100 are kept a fixed distance apart and manufacturing processes are simplified. However, the present invention is not limited thereto; a portion of the hole CAV may be in a common shape of a quadrangle or other kinds of shapes. A shape of the third micro-strip line 108 within the hole CAV may be corresponding to a shape of the hole CAV and may be modified according to the shape of the hole CAV, which is still within the scope of the present invention.

Moreover, to implement the multiband antennas 10, 40, 50, 60, materials such as flexible printed circuit boards or thin printed circuit boards may be applied, assembled on an antenna holder and then joined to application devices, for example, smart meters. Furthermore, it is also feasible if a conductive coating material is formed on a surface of the antenna holder by a coating process, a printing process or a laser direct structuring (LDS) process. The material of the antenna holder maybe acrylonitrile butadiene styrene (ABS), fiberglass reinforced epoxy resin (FR4) for forming flexible printed circuit boards or polyimide for forming flexible film substrates. What's more, the antenna holder may be integrated into the circuit so as to save space.

For multiband applications in the prior art, a plurality of antennas or a plurality of radiation entities (for example, slots in a slot antenna and branches in a dipole antenna) are commonly employed to respectively transmit and receive wireless signals of different frequency bands. Nevertheless, apart from complicating design further, the entire area of an antenna becomes larger as the required frequency bands increases. If the available space for antennas is rather limited, interference may occur among the antennas, which significantly affects performance of the antennas. In contrast, the multiband antenna of the present invention utilizes a unique feed-in and coupling structure so that merely one single radiation entity can achieve multiband operation. Moreover, properties of the antenna may be modified with a plurality of adjustable factors to meet different requirements.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multiband antenna, disposed on a surface for receiving or transmitting wireless signals of a plurality of frequency bands, the multiband antenna comprising:

a grounding sheet, formed with a hole at a first side, for providing grounding;

a first micro-strip line, parallel to the first side of the grounding sheet, having a first length equal to half of a wavelength of a wireless signal corresponding to a first frequency band of the plurality of frequency bands, wherein the first micro-strip line is formed with at least one gap to generate a second frequency band of the plurality of frequency bands, the second frequency band is higher than the first frequency band, and the at least one gap divides the first micro-strip line into a plurality of segments;

a connecting unit, connecting a terminal of the first side of the grounding sheet and a terminal of the first micro-strip line, for forming a resonant cavity with the first side of the grounding sheet and the first micro-strip line;

a second micro-strip line, disposed in the resonant cavity, parallel to the first micro-strip line, having a second length, and separated from the first micro-strip line by a first gap, wherein the first length of the first micro-strip line is longer than the second length of the second micro-strip line;

a third micro-strip line, extending from the hole of the grounding sheet to a terminal of the second micro-strip line, and separated from the grounding sheet by a second gap around the hole; and a feed-in terminal, formed on the third micro-strip line within the hole, for transmitting the wireless signals of the plurality of frequency bands.

2. The multiband antenna of claim 1, further comprising at least one matching block, extending from the first side of the grounding sheet toward the resonant cavity, for adjusting signal matching of the multiband antenna.

3. The multiband antenna of claim 1, wherein the third micro-strip line is substantially perpendicular to the second micro-strip line.

4. The multiband antenna of claim 1, wherein a shape of a portion of the third micro-strip line within the hole corresponds to a shape of the hole.

5. The multiband antenna of claim 1, wherein the hole substantially has a shape of semicircular.

6. The multiband antenna of claim 1, wherein a number of the at least one gap, a width of each of the at least one gap or a position of each of the at least one gap formed within the first micro-strip line relates to at least one radiation parameter of the multiband antenna.

7. The multiband antenna of claim 1, wherein a position of the hole at the first side, a length of the first micro-strip line, the first gap, a length of the second micro-strip line, a position of the second micro-strip line within the resonant cavity, or the second gap relates to at least one radiation parameter of the multiband antenna.

8. The multiband antenna of claim 1, wherein the connecting unit is not coupled to the third micro-strip line.

9. The multiband antenna of claim 1, wherein the second micro-strip line and the third micro-strip line constitute an L-shape structure.

* * * * *